US007892024B1

(12) United States Patent
Chen

(10) Patent No.: US 7,892,024 B1
(45) Date of Patent: Feb. 22, 2011

(54) COAXIAL CABLE CONNECTOR

(75) Inventor: Han-Jung Chen, Taipei (TW)

(73) Assignee: Ezconn Corporation, Taipei (TW)

( * ) Notice: Subject to any disclaimer, the term of this patent is extended or adjusted under 35 U.S.C. 154(b) by 0 days.

(21) Appl. No.: 12/761,669

(22) Filed: Apr. 16, 2010

(51) Int. Cl.
*H01R 9/05* (2006.01)

(52) U.S. Cl. ..... 439/578; 439/583

(58) Field of Classification Search ..... 439/578, 439/581–585

See application file for complete search history.

(56) References Cited

U.S. PATENT DOCUMENTS 7,566,236 B2 * 7/2009 Malloy et al. ..... 439/321
7,674,132 B1 * 3/2010 Chen ..... 439/578
7,806,725 B1 * 10/2010 Chen ..... 439/578
7,824,216 B2 * 11/2010 Purdy ..... 439/578
2008/0102696 A1 * 5/2008 Montena ..... 439/578

* cited by examiner

*Primary Examiner*—Thanh-Tam T Le
(74) *Attorney, Agent, or Firm*—Rosenberg, Klein & Lee

(57) ABSTRACT

A coaxial cable connector includes: coaxial and radially spaced inner sleeve and outer sleeve, a front end of the inner sleeve having an outer flange and a first and a second interface sections, a rear end of the inner sleeve having a rearward extending section; a nut having an inner flange at rear end; and a conductive grounding spring mounted between the first interface section of the inner sleeve and the inner flange of the nut. The conductive grounding spring has an inner annular section fitted around the first interface section of the inner sleeve in secure contact therewith, and multiple plate-like resilient tongue sections extending from an end of the inner annular section and outward bent for mechanically and electrically connecting with the inner flange of the nut. The coaxial cable connector can be reliably electrically connected with a threaded interface connector of an electronic device via the nut.

2 Claims, 4 Drawing Sheets

COAXIAL CABLE CONNECTOR

BACKGROUND OF THE INVENTION

1. Field of the Invention

The present invention relates generally to a connector, and more particularly to a coaxial cable connector with a good grounding effect.

2. Description of the Related Art

It is well known that a coaxial cable connector is connectable with a threaded interface connector of an electronic device to electrically connect a coaxial cable with the electronic device.

The conventional coaxial cable connector has some defects. For example, the main body of the coaxial cable connector must be connected with the interface connector with a good grounding connection. This is involved in whether the coaxial cable connector is well grounded. FIG. 1 shows an F-type connector as a typical example of the conventional connector. The F-type connector includes a connector main body 10. The connector main body 10 includes an outer sleeve 11, an inner sleeve 12 coaxially positioned in the outer sleeve 11 and a nut 13 rotatably fitted around the inner sleeve 12. The connector main body 10 serves to mechanically and electrically connect a coaxial cable with a threaded interface connector 15 of an electronic device 14.

There is an inherent problem existing in the connection between the F-type connector main body 10 and the threaded interface connector 15. That is, the nut 13 cannot be fully connected with the threaded interface connector 15 and a gap S is left between the inner sleeve 12 and the threaded interface connector 15. The gap S leads to poor contact between the connector main body 10 and the threaded interface connector 15 and poor grounding thereof. As a result, the electrical signal transmission performance is deteriorated.

It is therefore tried by the applicant to provide a grounding electrical connector, which can be effectively and lastingly connected with the threaded interface connector with a good grounding connection so as to achieve a good electrical performance.

SUMMARY OF THE INVENTION

A primary object of the present invention is to provide a coaxial cable connector, which includes a conductive grounding spring mounted between a nut and an inner sleeve. The conductive grounding spring has resilient tongue sections for securely mechanically and electrically connecting with an inner flange of the nut.

To achieve the above and other objects, the coaxial cable connector of the present invention includes: coaxial and radially spaced inner sleeve and outer sleeve, a front end of the inner sleeve having an outer flange and a first and a second interface sections, a rear end of the inner sleeve having a rearward extending section; a nut, a rear end of the nut having an inner flange; and a conductive grounding spring mounted between the first interface section of the inner sleeve and the inner flange of the nut. The conductive grounding spring has an inner annular section fitted around the first interface section of the inner sleeve in secure contact therewith, and multiple plate-like resilient tongue sections extending from an end of the inner annular section and outward bent and expanded for mechanically and electrically connecting with the inner flange of the nut. Accordingly, the coaxial cable connector can be reliably electrically connected with a threaded interface connector of an electronic device via the nut.

When the nut of the coaxial cable connector is fully locked to the threaded interface connector of the electronic device, the resilient tongue sections are compressed from an outward expanded position to a contracted position where the resilient tongue sections are positioned between the inner flange of the nut and the first interface section of the inner sleeve. Accordingly, the nut is securely electrically connected with the inner sleeve.

BRIEF DESCRIPTION OF THE DRAWINGS

The structure and the technical means adopted by the present invention to achieve the above and other objects can be best understood by referring to the following detailed description of the preferred embodiment and the accompanying drawings, wherein.

DETAILED DESCRIPTION OF THE PREFERRED EMBODIMENT

Figure 1:
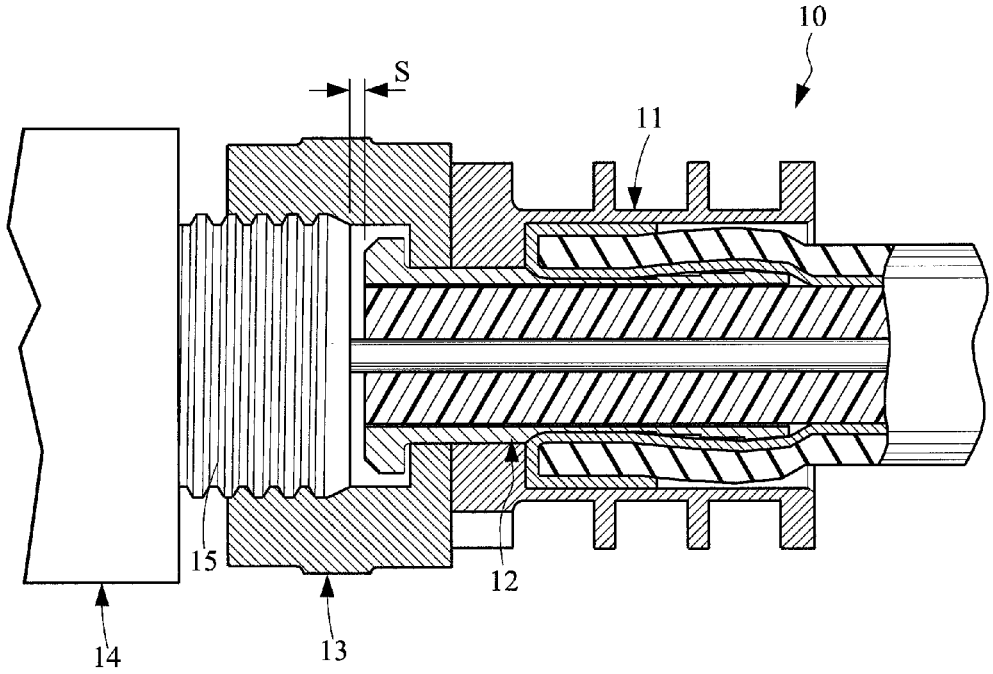
FIG.1 PRIOR ART
FIG. 1 is a sectional view showing that a conventional coaxial cable connector is not fully connected with a threaded interface connector of an electronic device.
Figure 2:
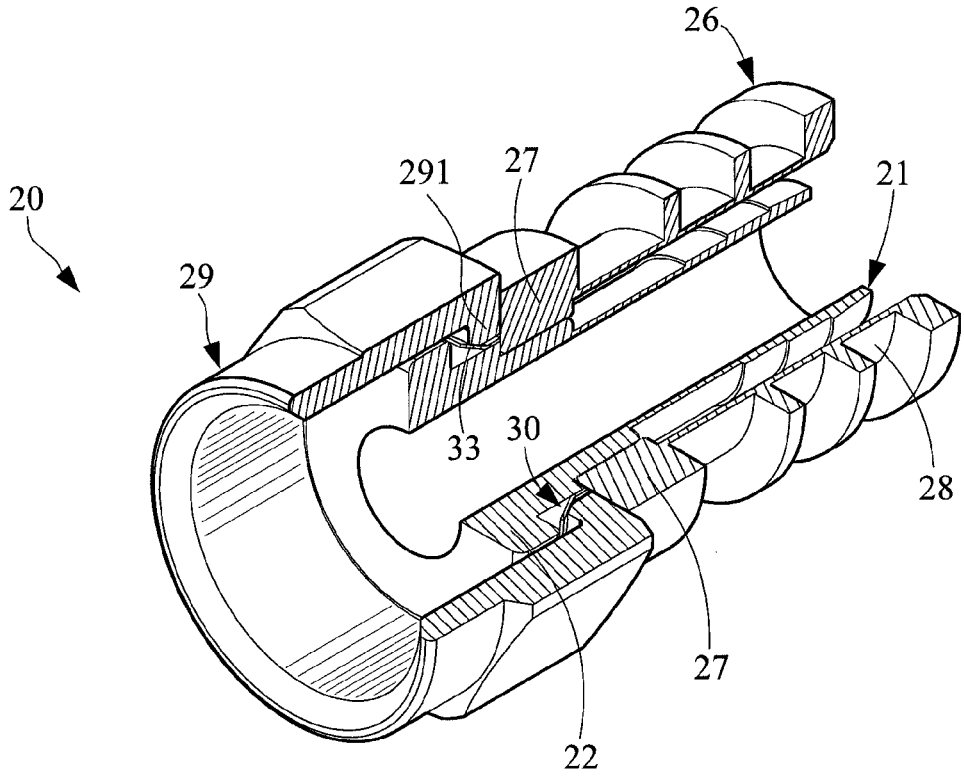
FIG. 2 is a perspective sectional view of the coaxial cable connector of the present invention.
Figure 3:
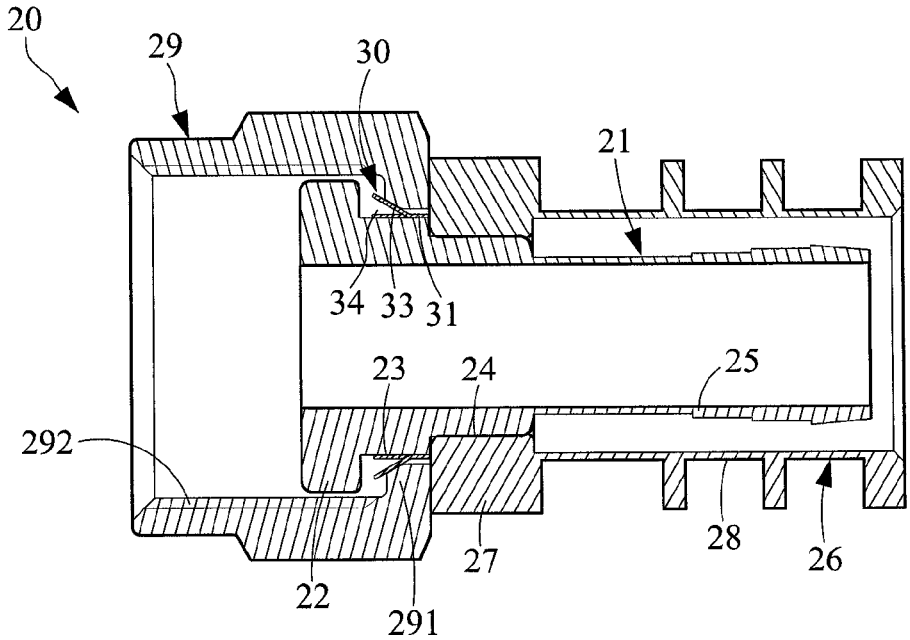
FIG. 3 is a sectional view of the coaxial cable connector of the present invention.

Please refer to FIGS. 2 and 3, in which FIG. 2 is a perspective sectional view of the coaxial cable connector of the present invention and FIG. 3 is a sectional view of the coaxial cable connector of the present invention. The coaxial cable connector 20 includes an inner sleeve 21, an outer sleeve 26 coaxially positioned around the inner sleeve 21 and radially spaced therefrom, and a conductive grounding spring 30. The inner and outer sleeve 21, 26 serve to coaxially receive a coaxial cable. A front end of the inner sleeve 21 has an outer flange 22, a first interface section 23, and a second interface section 24. A rear end of the inner sleeve 21 has a rearward extending section 25. The rearward extending section 25 has an outer diameter and a wall thickness smaller than those of the second interface section 24. A front end of the outer sleeve 26 has an outer sleeve main body 27 embracing the second interface section 24 of the inner sleeve 21. A rear end of the outer sleeve 26 has a rearward extending section 28. The rearward extending section 28 has an outer diameter and a wall thickness smaller than those of the outer sleeve main body 27. The rearward extending section 28 of the outer sleeve 26 coaxially surrounds the rearward extending section 25 of the inner sleeve 21 to define an annular space between the rearward extending section 28 of the outer sleeve 26 and the rearward extending section 25 of the inner sleeve 21. A nut 29 is disposed at a front end of the coaxial cable connector 20. A rear end of the nut 29 has an inner flange 291 freely rotatably sandwiched between the outer flange 22 and the outer sleeve main body 27. The nut 29 is formed with an inner thread 292 and an outer hexagonal section, whereby the coaxial cable connector 20 can be locked to an electronic device via the nut 29 by means of a wrench or the like tool.

Figure 4:
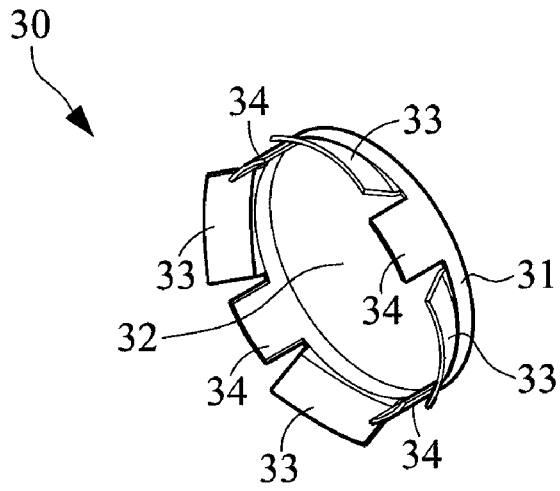
FIG. 4 is a perspective view of the conductive grounding spring of the coaxial cable connector of the present invention.
Figure 5:
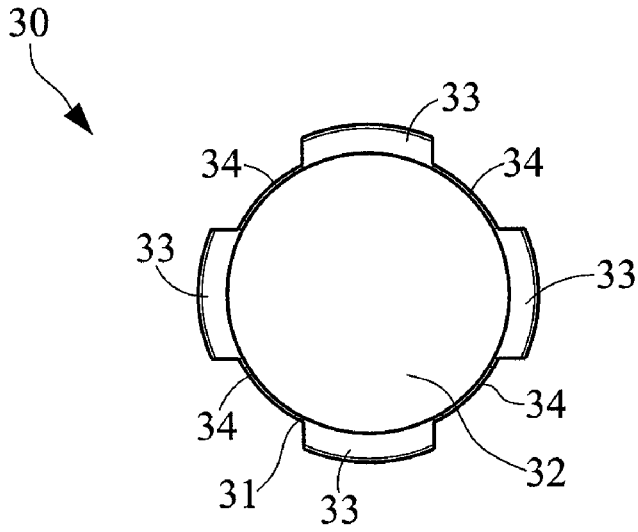
FIG. 5 is a left view of the conductive grounding spring of the coaxial cable connector of the present invention.

Referring to FIGS. 4 and 5, the conductive grounding spring 30 includes an inner annular section 31 defining a hole 32. The hole 32 has such a diameter that the spring 30 can be fitted around the first interface section 23 of the inner sleeve 21 in secure contact with a circumference of the first interface section 23. The conductive grounding spring 30 further includes multiple plate-like resilient tongue sections 33 formed at an end of the inner annular section 31 at equal intervals. The resilient tongue sections 33 extend from the end of the inner annular section 31 and are outward bent and expanded by a predetermined angle for mechanically and electrically connecting with the inner flange 291 of the nut 29 (as shown in FIG. 3). Accordingly, the coaxial cable connector 20 can be reliably electrically connected with an electronic device 40 via the nut 29 so as to ensure good signal transmission quality and good electrical performance.

The conductive grounding spring 30 further includes multiple plate-like outer arcuate sections 34 integrally connected with the inner annular section 31 and positioned between the resilient tongue sections 33. The outer arcuate sections 34 tightly contact with the circumference of the first interface section 23, whereby the conductive grounding spring 30 is more securely connected with the inner sleeve 21.

Figure 6A:
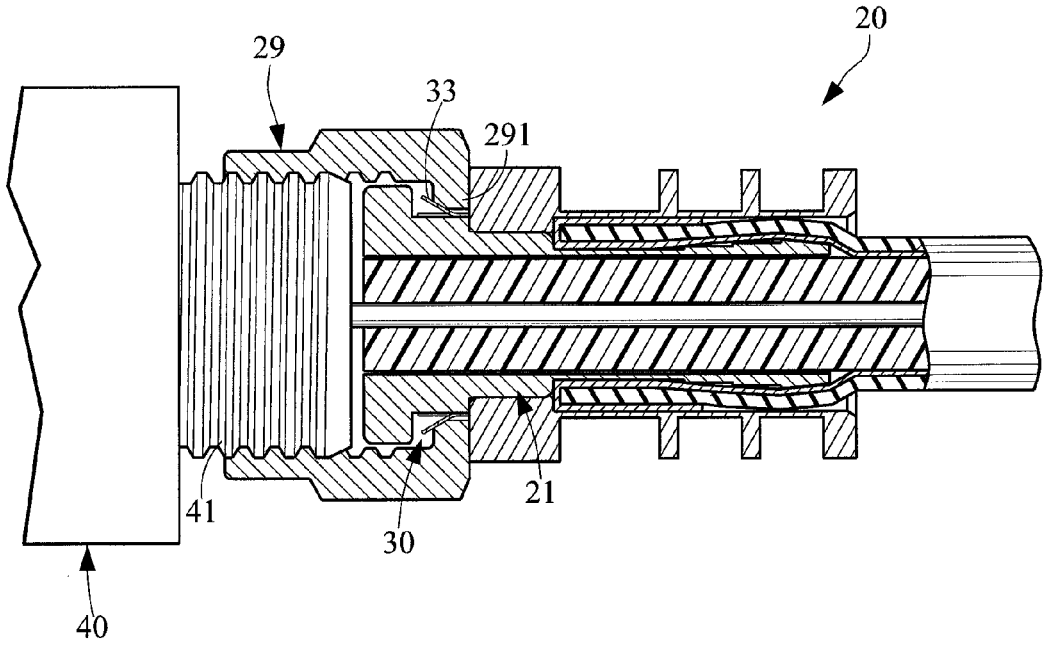
FIGS. 6A and 6B show the connection process of the coaxial cable connector of the present invention with a threaded interface connector of an electronic device.
Figure 6B:
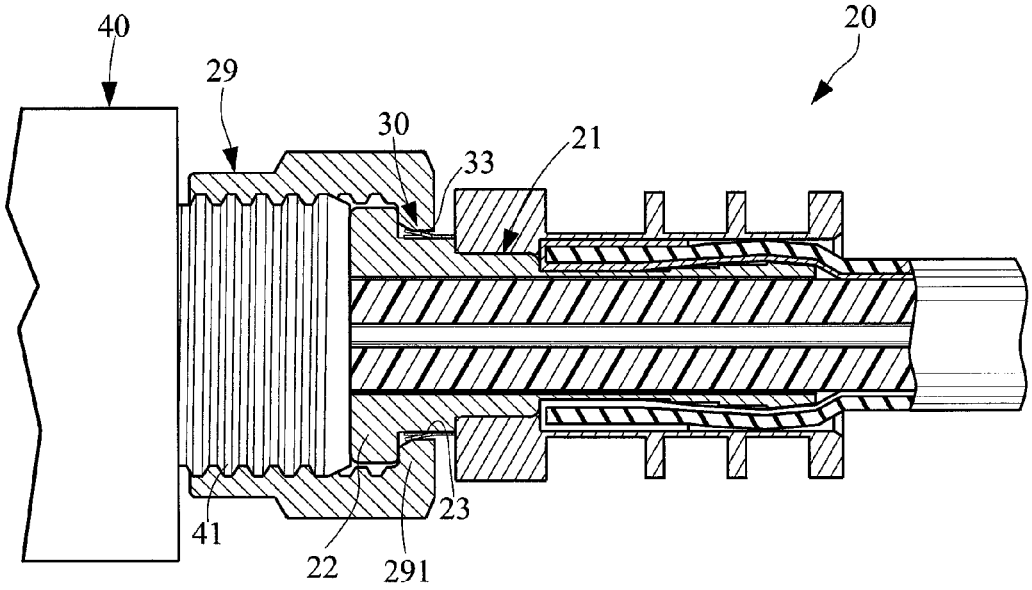

FIGS. 6A and 6B show the installation process of the coaxial cable connector 20 to the electronic device 40. First, the coaxial cable connector 20 is locked to the electronic device 40. At this time, the nut 29 has not yet fully connected with a threaded interface connector 41 of the electronic device 40. In the coaxial cable connector 20, the nut 29 is in good metal-to-metal contact with the inner sleeve 21 via the resilient tongue sections 33 of the conductive grounding spring 30. Substantially, the resilient tongue sections 33 are outward expanded by a predetermined angle in contact with the inner flange 291 of the nut 29. Accordingly, the coaxial cable connector 20 can be reliably electrically connected with the electronic device 40 via the nut 29 as shown in FIG. 6A.

Afterwards, the nut 29 is fully locked onto the threaded interface connector 41 of the electronic device 40 to make the outer flange 22 of the inner sleeve 21 into contact with the inner flange 291 of the nut 29. When locked, the resilient tongue sections 33 of the conductive grounding spring 30 are compressed from an outward expanded position (as shown in FIG. 6A) to a contracted position (as shown in FIG. 6B). Eventually, the resilient tongue sections 33 are positioned between the inner flange 291 of the nut 29 and the first interface section 23 of the inner sleeve 21. In this case, the nut 29 is securely electrically connected with the inner sleeve 21.

The above embodiment is only used to illustrate the present invention, not intended to limit the scope thereof. It is understood that many changes or modifications of the above embodiment can be made by those who are skilled in this field without departing from the spirit of the present invention. The scope of the present invention is limited only by the appended claims.

The invention claimed is:

1. A coaxial cable connector for mechanically and electrically connecting a coaxial cable with a threaded interface connector of an electronic device, the coaxial cable connector comprising:

an inner sleeve, a front end of the inner sleeve having an outer flange, a first interface section, and a second interface section, a rear end of the inner sleeve having a rearward extending section;

an outer sleeve coaxially positioned around the inner sleeve;

a nut rotatably connected with the threaded interface connector of the electronic device, a rear end of the nut having an inner flange; and a conductive grounding spring mounted between the first interface section of the inner sleeve and the inner flange of the nut, the conductive grounding spring having an inner annular section fitted around the first interface section of the inner sleeve in secure contact with a circumference of the first interface section, the conductive grounding spring further having multiple plate-like resilient tongue sections formed at an end of the inner annular section at intervals, the resilient tongue sections extending from the end of the inner annular section and being outward bent and expanded for mechanically and electrically connecting with the inner flange of the nut, whereby the coaxial cable connector can be reliably electrically connected with the electronic device via the nut, when the nut of the coaxial cable connector is fully locked to the threaded interface connector of the electronic device, the resilient tongue sections being compressed from an outward expanded position to a contracted position where the resilient tongue sections are positioned between the inner flange of the nut and the first interface section of the inner sleeve, whereby the nut is securely electrically connected with the inner sleeve.

2. The coaxial cable connector as claimed in claim 1, wherein the conductive grounding spring further includes multiple plate-like outer arcuate sections integrally connected with the inner annular section and positioned between the resilient tongue sections, the outer arcuate sections being securely connected with the circumference of the first interface section of the inner sleeve.

* * * * *